US008188646B2

(12) United States Patent
Ikeda et al.

(10) Patent No.: US 8,188,646 B2
(45) Date of Patent: May 29, 2012

(54) FLUORESCENT LAMP AND BASE WITH PRESS-FIT HOLE

(75) Inventors: Mitsuhiro Ikeda, Shizuoka (JP); Takashi Osawa, Shizuoka (JP); Masaomi Takeda, Shizuoka (JP); Koji Kokufu, Shizuoka (JP)

(73) Assignee: Osram-Melco Ltd., Kanagawa (JP)

( * ) Notice: Subject to any disclaimer, the term of this patent is extended or adjusted under 35 U.S.C. 154(b) by 366 days.

(21) Appl. No.: 12/105,930

(22) Filed: Apr. 18, 2008

(65) Prior Publication Data

US 2009/0264000 A1 Oct. 22, 2009

Related U.S. Application Data

(62) Division of application No. 10/544,831, filed on Aug. 8, 2005, now Pat. No. 7,456,559.

(51) Int. Cl.
*H01J 5/48* (2006.01)
*H01J 17/00* (2006.01)

(52) U.S. Cl. ..... 313/318.01; 313/318.05; 313/318.06; 313/318.12

(58) Field of Classification Search ..... None
See application file for complete search history.

(56) References Cited

U.S. PATENT DOCUMENTS

| | | | | |
|---|---|---|---|---|
| 2,454,326 | A | 11/1948 | Makenny | |
| 3,458,747 | A | 7/1969 | Gainer et al. | |
| 3,749,467 | A * | 7/1973 | Emidy et al. | 445/26 |
| 4,326,146 | A | 4/1982 | Plagge et al. | |
| 4,985,656 | A | 1/1991 | Westlund, Jr. et al. | |
| 5,534,584 | A * | 7/1996 | Kitamura et al. | 524/497 |
| 5,634,820 | A | 6/1997 | Vakil | |
| 6,268,687 | B1 | 7/2001 | Fülöp et al. | |
| 6,319,076 | B1 | 11/2001 | Gollhofer et al. | |
| 6,628,054 | B1 * | 9/2003 | Busai et al. | 313/318.01 |
| 6,774,564 | B1 | 8/2004 | Pilhoefer et al. | |
| 7,456,559 | B2 * | 11/2008 | Ikeda et al. | 313/318.01 |
| 2001/0000421 | A1 * | 4/2001 | Ge | 313/493 |
| 2001/0049424 | A1 * | 12/2001 | Petiniot et al. | 526/89 |
| 2004/0235998 | A1 | 11/2004 | Kirchner | |
| 2006/0139924 | A1 * | 6/2006 | Ikeda et al. | 362/260 |

FOREIGN PATENT DOCUMENTS

| | | | |
|---|---|---|---|
| DE | 3439137 | A1 | 5/1986 |
| DE | 19928419 | C1 | 2/2001 |
| JP | 59-128752 | A | 7/1984 |
| JP | 59-184432 | A | 10/1984 |
| JP | 61-146851 | U | 9/1986 |
| JP | 01-115026 | A | 5/1989 |
| JP | 8-273602 | A | 10/1996 |
| JP | 2001-307680 | A | 11/2001 |

* cited by examiner

*Primary Examiner* — Tracie Y Green
(74) *Attorney, Agent, or Firm* — Birch, Stewart, Kolasch & Birch, LLP

(57) ABSTRACT

At the end of life of a fluorescent lamp having a base to which a pin is press-fitted, it is an object to prevent the pin from dropping or slanting, etc. A fluorescent lamp includes a base having a base body and a pin press-fitted to a hole formed on the base body. A pin retaining force (a pin torque of the base) Fe after use by which the base body retains the pin is at least 0.08 Nm after the fluorescent lamp is burned for a rated life, and a rate Fe/Fi of an initial pin retaining force Fi by which the base body retains the pin before use of the fluorescent lamp and the pin retaining force Fe after use is at least 0.66.

18 Claims, 20 Drawing Sheets

| GLASS FILLER CONTENT (WT%) | Dh/Dp | Fi (Nm) | CRACK GENERATION RATE (%) |
|---|---|---|---|
| 5 | 0.97 | 0.102 | 0 |
| 15 | | 0.110 | 0 |
| 30 | | 0.120 | 0 |
| 40 | | 0.126 | 3.6 |
| 60 | | 0.139 | 10.3 |
| 15 | 0.85 | 0.132 | 8.8 |

Fig.5

| GLASS FILLER CONTENT (WT%) | Dh/Dp | WHITE PIGMENT $TiO_2$ (WT%) | Fe (Nm) | NO. OF PIECES IN WHICH DROPPING OR SLANTING OCCURS (PIECES PER 20 PIECES) |
|---|---|---|---|---|
| 5 | 0.97 | 5 | 0.063 | 11 |
| 15 | | | 0.067 | 7 |
| 30 | | | 0.074 | 3 |
| 40 | | | 0.080 | 0 |
| 60 | | | 0.088 | 0 |
| 15 | | 10 | 0.049 | 17 |
| 15 | 0.85 | 5 | 0.081 | 0 |

Fig.7

| | Fi | | |
|---|---|---|---|
| Dh/Dp | GLASS FILLER 5% | GLASS FILLER 15% | GLASS FILLER 30% |
| 0.85 | 0.133 | 0.139 | 0.145 |
| 0.87 | 0.125 | 0.133 | 0.136 |
| 0.89 | 0.120 | 0.127 | 0.130 |
| 0.9 | 0.116 | 0.124 | 0.129 |
| 0.92 | 0.111 | 0.119 | 0.125 |
| 0.94 | 0.107 | 0.116 | 0.121 |
| 0.96 | 0.105 | 0.113 | 0.12 |
| 0.97 | 0.102 | 0.111 | 0.118 |
| 0.98 | 0.101 | 0.106 | 0.113 |
| 0.99 | 0.09 | 0.096 | 0.101 |
| 0.995 | 0.069 | 0.075 | 0.081 |

Fig.9

| | | WHITE PIGMENT : $TiO_2$ (WT%) | | | | | |
|---|---|---|---|---|---|---|---|
| | | 0 | 1 | 2 | 3 | 5 | 10 |
| GLASS FILLER (WT%) | 0 | EXAMPLE 1 | | EXAMPLE 9 | | | |
| | 5 | EXAMPLE 2 | EXAMPLE 6 | EXAMPLE 10 | EXAMPLE 15 | COMPARISON 6 | |
| | 15 | EXAMPLE 3 | EXAMPLE 7 | EXAMPLE 11 | EXAMPLE 16 | COMPARISON 1 | COMPARISON 5 |
| | 30 | EXAMPLE 4 | EXAMPLE 8 | EXAMPLE 12 | EXAMPLE 17 | COMPARISON 2 | |
| | 40 | EXAMPLE 5 | | EXAMPLE 13 | | COMPARISON 3 | |
| | 60 | | | EXAMPLE 14 | | COMPARISON 4 | |

Fig.10

| GLASS FILLER (WT%) | WHITE PIGMENT : $TiO_2$ (WT%) | | | | | |
|---|---|---|---|---|---|---|
| | 0 | 1 | 2 | 3 | 5 | 10 |
| 15 | EXAMPLE 18 | | EXAMPLE 19 | | EXAMPLE 20 | EXAMPLE 21 |

Fig.11

| | | | WHITE PIGMENT : $TiO_2$ (WT%) | | | | | |
|---|---|---|---|---|---|---|---|---|
| | | | 0 | 1 | 2 | 3 | 5 | 10 |
| GLASS FILLER (WT%) | 0 | Fi | 0.079 | | 0.080 | | | |
| | | Fe | 0.065 | | 0.062 | | | |
| | | Fe/Fi | 0.82 | | 0.78 | | | |
| | 5 | Fi | 0.102 | 0.103 | 0.104 | 0.101 | 0.102 | |
| | | Fe | 0.084 | 0.083 | 0.081 | 0.075 | 0.063 | |
| | | Fe/Fi | 0.82 | 0.81 | 0.78 | 0.74 | 0.62 | |
| | 15 | Fi | 0.111 | 0.110 | 0.110 | 0.112 | 0.110 | 0.112 |
| | | Fe | 0.091 | 0.088 | 0.086 | 0.082 | 0.067 | 0.049 |
| | | Fe/Fi | 0.82 | 0.80 | 0.78 | 0.73 | 0.61 | 0.44 |
| | 30 | Fi | 0.118 | 0.119 | 0.117 | 0.118 | 0.120 | |
| | | Fe | 0.095 | 0.094 | 0.090 | 0.085 | 0.074 | |
| | | Fe/Fi | 0.81 | 0.79 | 0.77 | 0.72 | 0.62 | |
| | 40 | Fi | 0.126 | | 0.125 | | 0.126 | |
| | | Fe | 0.102 | | 0.096 | | 0.080 | |
| | | Fe/Fi | 0.81 | | 0.77 | | 0.63 | |
| | 60 | Fi | | | 0.136 | | 0.139 | |
| | | Fe | | | 0.104 | | 0.088 | |
| | | Fe/Fi | | | 0.76 | | 0.63 | |

Fig.12

NOT PRACTICAL

| GLASS FILLER (WT%) | | WHITE PIGMENT (WT%) | | | |
|---|---|---|---|---|---|
| | | 0 | 2 | 5 | 10 |
| 15 | Fi | 0.133 | 0.134 | 0.132 | 0.136 |
| | Fe | 0.104 | 0.096 | 0.081 | 0.064 |
| | Fe/Fi | 0.78 | 0.72 | 0.61 | 0.47 |

Fig.13

| | GLASS FILLER (WT%) | WHITE PIGMENT $TiO_2$ (%) | Fi (Nm) | CRACK GENERATION RATE (%) | Fe (Nm) | NO. OF PIECES IN WHICH DROPPING OR SLANTING OCCURS (PIECES PER 20 PIECES) |
|---|---|---|---|---|---|---|
| EXAMPLE 7 | 5 | 2 | 0.104 | 0 | 0.081 | 0 |
| COMPARISON 1 | 15 | 5 | 0.110 | 0 | 0.067 | 7 |
| EXAMPLE 4 | 30 | 0 | 0.118 | 0 | 0.095 | 0 |
| EXAMPLE 17 | | 3 | 0.118 | 0 | 0.085 | 0 |
| COMPARISON 4 | 60 | 5 | 0.139 | 10.3 | 0.088 | 0 |

Fig.14

| | | WHITE PIGMENT : $TiO_2$ (WT%) | | | | |
|---|---|---|---|---|---|---|
| | | 0 | 1 | 2 | 5 | 10 |
| CARBON CONTENT (WT%) | 0 | EXAMPLE 3 | EXAMPLE 7 | EXAMPLE 11 | COMPARISON 1 | COMPARISON 5 |
| | 0.1 | EXAMPLE 22 | EXAMPLE 23 | EXAMPLE 24 | | |
| | 0.2 | EXAMPLE 25 | EXAMPLE 26 | EXAMPLE 27 | | |
| | 0.5 | EXAMPLE 28 | EXAMPLE 29 | EXAMPLE 30 | | |
| | 1.0 | EXAMPLE 31 | | | | |

Fig.16

| | | | WHITE PIGMENT : $TiO_2$ (WT%) | | | | |
|---|---|---|---|---|---|---|---|
| | | | 0 | 1 | 2 | 5 | 10 |
| CARBON CONTENT (WT%) | 0 | DISCOLORING | × | × | △ | ● | ● |
| | 0.1 | DISCOLORING | △ | △ | ○ | | |
| | 0.2 | DISCOLORING | ○ | ○ | ● | | |
| | 0.5 | DISCOLORING | ● | ● | ● | | |
| | 1.0 | DISCOLORING | ● | | | | |

REMARKS

● : NO DISCOLORING (NO SUBJECT RECOGNIZES DISCOLORING)
○ : SLIGHTLY DISCOLORING (3 OUT OF 5 SUBJECTS RECOGNIZE DISCOLORING)
△ : DISCOLORING TO LIGHT BROWN (ALL SUBJECTS RECOGNIZE DISCOLORING)
× : DISCOLORING TO BROWN (ALL SUBJECTS RECOGNIZE DISCOLORING)

Fig.17

| | | | WHITE PIGMENT : $TiO_2$ (WT%) | | | |
|---|---|---|---|---|---|---|
| | | | 0 | 2 | 5 | 10 |
| CARBON CONTENT (WT%) | 0 | Fi | 0.111 | 0.110 | 0.110 | 0.112 |
| | | Fe | 0.091 | 0.086 | 0.067 | 0.049 |
| | | Fe/Fi | 0.82 | 0.78 | 0.61 | 0.44 |
| | 0.5 | Fi | 0.113 | 0.112 | | |
| | | Fe | 0.093 | 0.088 | | |
| | | Fe/Fi | 0.82 | 0.79 | | |
| | 1.0 | Fi | 0.114 | | | |
| | | Fe | 0.094 | | | |
| | | Fe/Fi | 0.82 | | | |

Fig.18

| SYMBOL FOR TYPE AND DIMENSION | | CATEGORY | BASE SHEET No. | CORRESPONDING IEC SHEET No. | REMARKS |
|---|---|---|---|---|---|
| G TYPE | G23 | G23 | 1-45-1 | 7004-69-1 | |
| | G24 | G24d | 1-46-1 | 7004-78-2 | |
| GRX TYPE | GRX10 | GRX10q | 1-48-1 | 7004-101-1 | |
| GX TYPE | GX10 | GX10q | 1-53-1 | 7004-84-2 | |
| | GX23 | GX23 | 1-55-1 | 7004-86-1 | |
| | GX24 | GX24q | 1-56-1 | 7004-78-2 | |
| GY TYPE | GY10 | GY10q | 1-60-1 | 7004-85-2 | |
| 2G TYPE | 2G11 | 2G11 | 1-64-1 | 7004-82-1 | |
| | 2G10 | | | | ONLY ICE |

Fig.20

FLUORESCENT LAMP AND BASE WITH PRESS-FIT HOLE

The present application is a divisional of U.S. patent application Ser. No. 10/544,831, filed Aug. 8, 2005 now U.S. Pat. No. 7,456,559, which was originally filed as PCT/JP2003/11207 on Sep. 2, 2003, the entire contents of which are hereby incorporated by reference.

TECHNICAL FIELD

The present invention relates to a base for a fluorescent lamp to which a metal pin is inserted by press-fitting and a fluorescent lamp using the base.

BACKGROUND ART

At the time of manufacturing a base, it is desired that a metal pin retaining force (a pin torque of the base) of a base body be within a range of 0.10 Nm to 0.12 Nm. When the retaining force is less than 0.10 Nm, failure may occur such as dropping of a pin. On the other hand, if the retaining force is greater than 0.12 Nm, the pin torque can be kept a sufficient value; however, a crack of the base may frequently occur when the pin is inserted, and much chaff may be generated from peeled base resin, which causes an adverse effect on the productivity.

In addition, to make the metal pin retaining force (a pin torque of the base) of the base body stay within the range of 0.10 Nm to 0.12 Nm, a method is taken in which a rate Dh/Dp of a hole diameter Dh and an outer diameter Dp of the pin is kept within a range of 0.96 to 0.98 when the pin is inserted by press-fitting, and glass filler, which is used as a reinforcement member, is kept within a range of 5 wt % (percent by weight) to 30 wt %.

To keep the metal pin retaining force of the base body at the time of manufacturing the base within the range of 0.10 Nm to 0.12 Nm and to attain other characteristics (heat resistance, incombustibility, colorfastness, etc.) required for the base of the fluorescent lamp, such as optimal selection of resin or optimization of compounding ratio of pigment, etc. have been conducted. For example, heat resistant polybutylene terephtbalate (PBT), polyethylene terephthalate (PET), etc. are selected as thermoplastic resin, and further, white pigment such as titanium oxide is added to keep a good appearance of the base and to prevent discoloring due to the heat generated by burning. The white pigment of 5-10 wt % is added to make body colr of the base body white and prevent discoloring due to high temperature, etc.

Further, JP08-273602 discloses technique to color a resin case containing a burning circuit in dark color.

In the conventional art, there sometimes occurs a problem that even if the base body has a sufficient metal pin retaining force at the time of manufacturing the base, the pin drops at the time of attaching/removing the lamp to/from a luminaire in the market. It is known that such a problem occurs more frequently at the end of life (burning time: approximately 10,000 hours) of the fluorescent lamp.

Therefore, the present invention aims to, from an initial stage of using a fluorescent lamp to the end of the life of lamp, prevent the lamp from falling from a luminaire because a pin drops when the lamp is attached/removed to/from the luminaire and while the lamp is burned.

DISCLOSURE OF THE INVENTION

According to the present invention, a fluorescent lamp includes a base having a base body and a pin press-fitted to a hole formed on the base body, and the fluorescent lamp has at least 0.08 Nm of a pin retaining force (a pin torque of the base) Fe after use by which the base body retains the pin when the fluorescent lamp has been burned for a rated life.

Further, a rate Fe/Fi of an initial pin retaining force Fi by which the base body retains the pin before use of the fluorescent lamp and the pin retaining force Fe after use is at least 0.66.

Further, a rate Fe/Fi of an initial pin retaining force Fi by which the base body retains the pin before use of the fluorescent lamp and the pin retaining force Fe is at least 0.8.

Further, a rate Dh/Dp of a hole diameter Dh of a hole provided at the base body and an outer diameter Dp of the pin is at least 0.89 but no more than 0.99.

Further, a rate Dh/Dp of a hole diameter Dh of a hole provided at the base body and an outer diameter Dp of the pin is at least 0.96 but no more than 0.98.

A temperature of the base during burning is at least 70 degrees Celsius.

The rated life is 10,000 hours.

The base body is made of thermoplastic resin, and the fluorescent lamp includes a cover part engaged with the base body, to which four metal pins are press-fitted by setting two pairs of the four metal pins in parallel, and an arc tube set to a hole provided on the cover part.

The thermoplastic resin contains white pigment of no more than 0 wt % (percent by weight) and no more than 3 wt % and glass filler of at least 5 wt % but no more than 30 wt %.

The thermoplastic resin contains the white pigment of at least 0 wt % but no more than 2 wt %.

The thermoplastic resin contains black pigment of at least 0.2 wt %.

The black pigment includes carbon black.

The base body is one of black and dark color, and the cover part is white.

According to the present invention, a fluorescent lamp includes a base having a base body made of thermoplastic resin, a hole provided on the base body, and a pin press-fitted to the hole, and the thermoplastic resin contains white pigment of at least 0 wt % but no more than 3 wt % and glass filler of at least 5 wt % but no more than 30 wt %.

According to the present invention, a fluorescent lamp includes a base having a base body and a pin press-fitted to a hole formed on the base body, and a rate Fe/Fi of an initial pin retaining force (a pin torque of the base) Fi by which the base body retains the pin before use of the fluorescent lamp and a pin retaining force Fe after use by which the base body retains the pin after the fluorescent lamp is burned for a rated life is at least 0.66.

According to the present invention, a base includes a base body and a pin press-fitted to a hole formed on the base body, and a pin retaining force (a pin torque of the base) Fe after use by which the base body retains the pin after burning for a rated life is at least 0.08 Nm.

Further, a rate Fe/Fi of an initial pin retaining force Fi by which the base body retains the pin before use of the fluorescent lamp and the pin retaining force Fe after use is at least 0.66.

Further, a rate Dh/Dp of a hole diameter Dh of the hole provided on the base body and an outer diameter Dp of the pin is at least 0.89 but no more than 0.99.

The thermoplastic resin contains white pigment of at least 0 wt % but no more than 3 wt % and glass filler of at least 5 wt % but no more than 30 wt %.

According to the present invention, a base includes a base having a base body made of thermoplastic resin, a hole provided on the base body, and a pin press-fitted to the hole, and the thermoplastic resin contains white pigment of at least 0 wt % but no more than 3 wt % and glass filler of at least 5 wt % but no more than 30 wt %.

Further, a rate Dh/Dp of a hole diameter Dh of the hole formed on the base body and an outer diameter Dp of the pin is at least 0.89 but no more than 0.99.

According to the present invention, a base includes a base having a base body and a pin press-fitted to a hole provided on the base body, and a rate Fe/Fi of an initial pin retaining force (a pin torque of the base) Fi by which the base body retains the pin before a fluorescent lamp is used and a pin retaining force Fe after use by which the base body retains the pin after the fluorescent lamp is burned for a rated life is at least 0.66.

BRIEF EXPLANATION OF THE DRAWINGS

FIG. 5 is a diagram (a table) showing a test result of relation between an initial pin retaining force Fi and a crack generation rate (%) at the time of inserting a pin.

FIG. 7 shows a test result of relation between a pin retaining force Fe (Nm) after use after burning for 10,000 hours and occurrence of a pin-dropping or a pin-slanting at the time of attaching/removing the lamp to/from a lamp holder.

FIG. 9 is a diagram (a table) showing a test result of relation between a rate Dh/Dp and an initial pin retaining force Fi (Nm).

FIG. 10 is a diagram (a table) showing combinations of glass filler content and quantity of white pigment addition.

FIG. 11 is a diagram (a table) showing combinations of glass filler content and quantity of white pigment addition.

FIG. 12 is a diagram (a table) showing a measurement result of the pin retaining force for each combination of Examples and Comparisons shown in FIG. 10.

FIG. 13 is a diagram (a table) showing a measurement result of the pin retaining force for each combination of Examples shown in FIG. 11.

FIG. 14 is a diagram (a table) showing a base crack generation rate and the number of occurrences of a pin-dropping or a pin-slanting for representative cases of Examples.

FIG. 16 is a diagram (a table) showing combinations of carbon black content and quantity of white pigment addition.

FIG. 17 is a diagram (a table) showing a test result of relation between carbon black content and discoloring.

FIG. 18 is a table showing a test result of relation between carbon black content, an initial pin retaining force Fi, and a pin retaining force Fe after use.

FIG. 20 is a diagram (a table) showing an example of types of bases to which the present invention can be applied.

PREFERRED EMBODIMENTS FOR CARRYING OUT THE INVENTION

Embodiment 1

Figure 1:
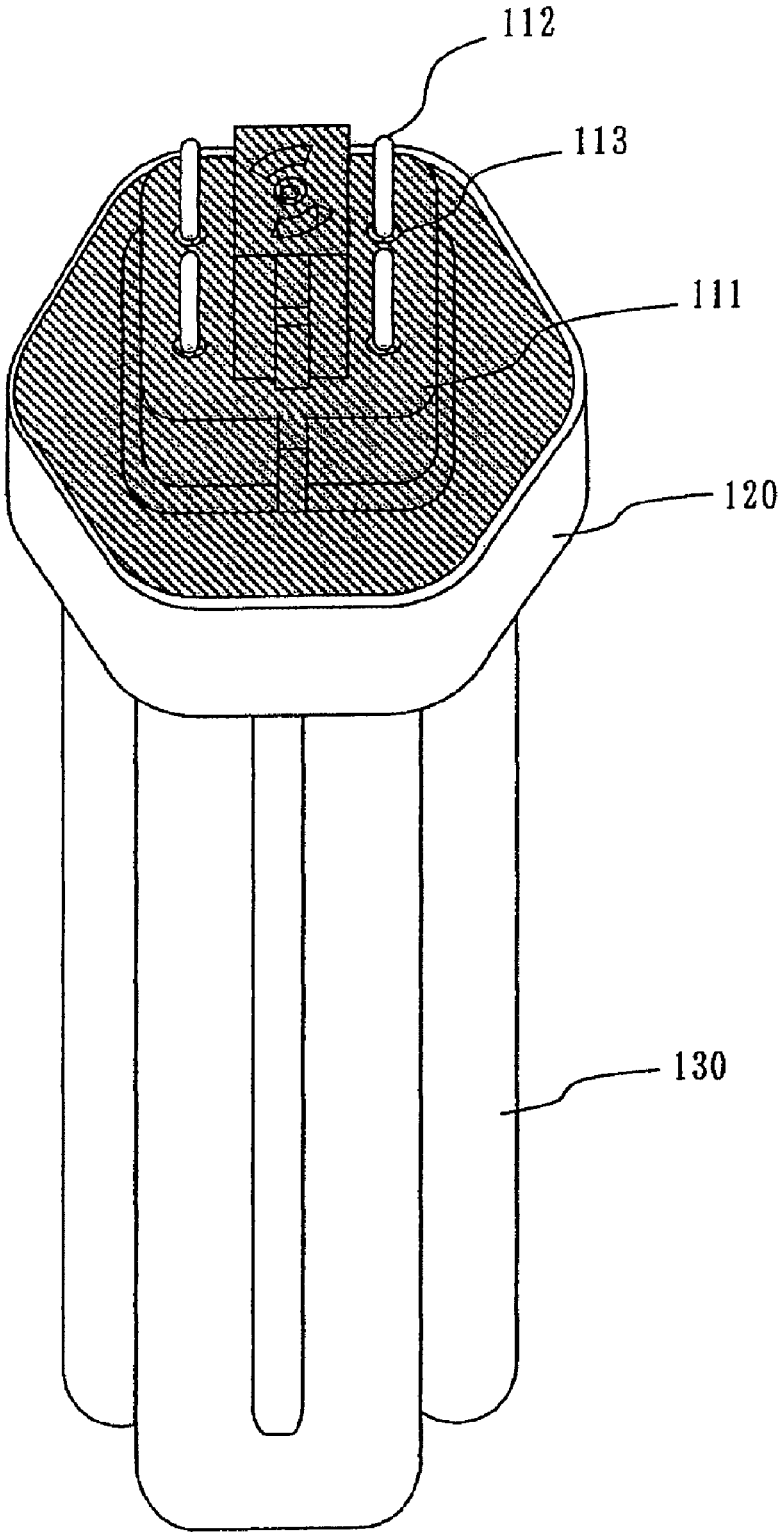
FIG. 1 shows an example of a fluorescent lamp that will be explained in an embodiment.

FIG. 1 shows an example of a fluorescent lamp that will be explained in an embodiment.

FIG. 1 shows a perspective view of a single capped fluorescent lamp as an example of the fluorescent lamp.

Figure 2:
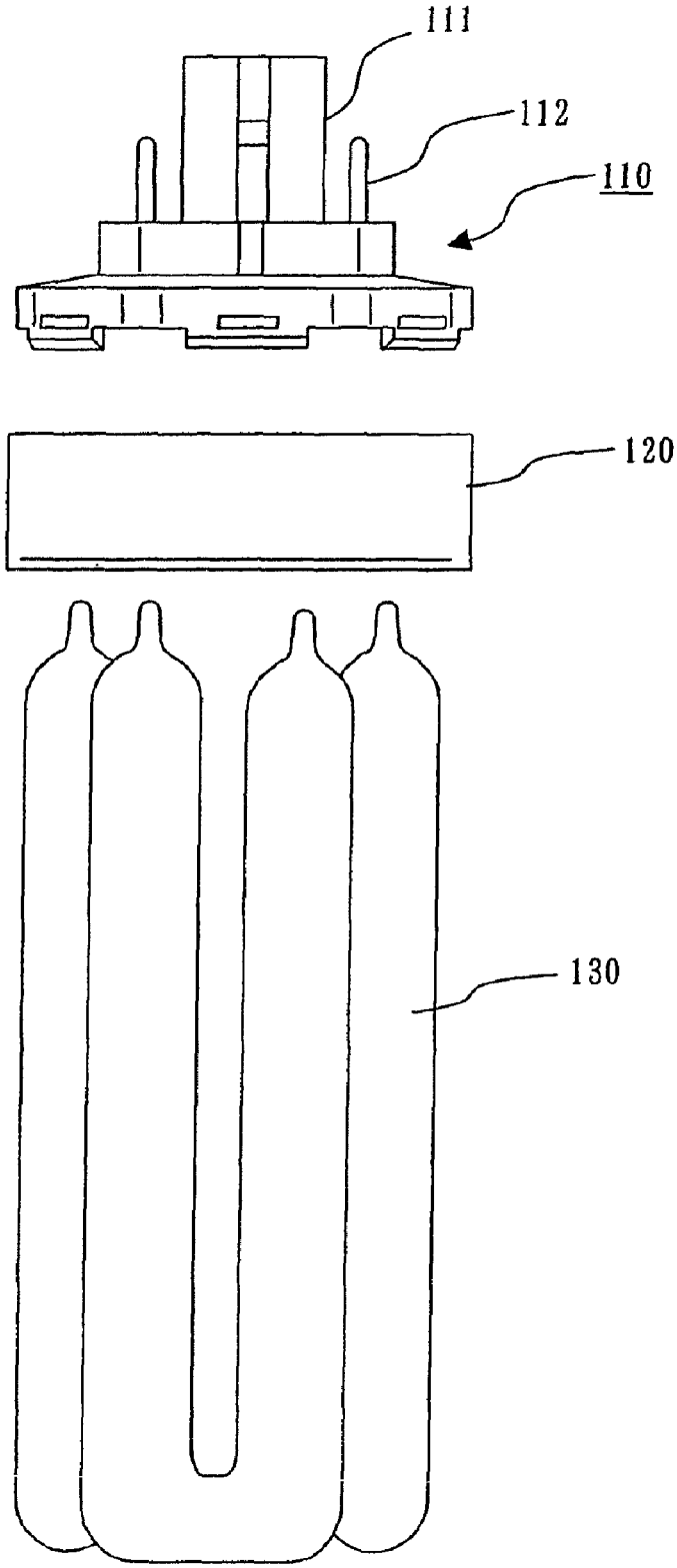
FIG. 2 is a diagram of a single capped fluorescent lamp shown in FIG. 1, separated to configuring components.
Figure 3A:
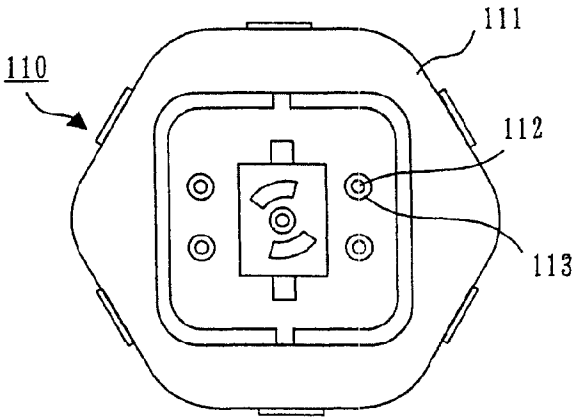
FIG. 3 shows a base 110 in detail.
Figure 3B:
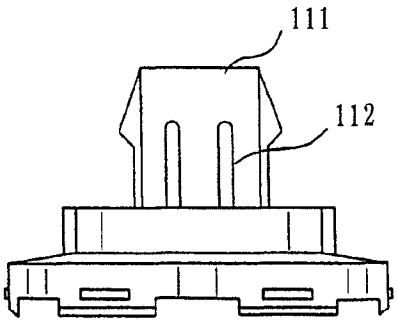
Figure 3C:
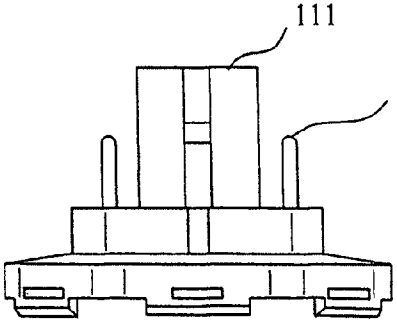
Figure 3D:
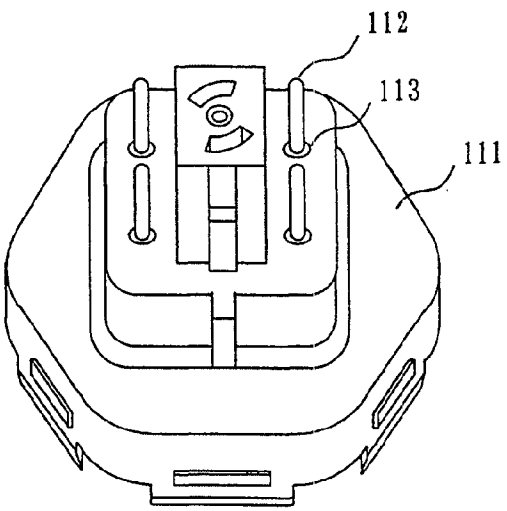
Figure 3E:
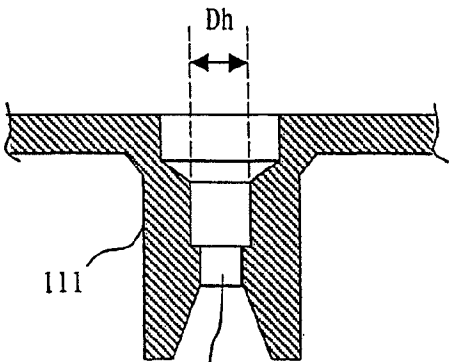
Figure 3F:
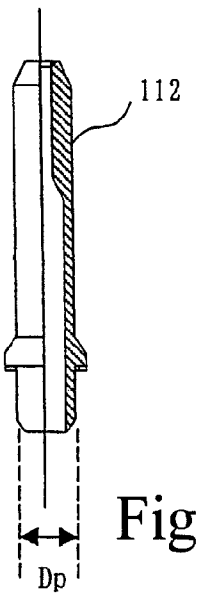

FIG. 2 is a diagram of a single capped fluorescent lamp shown in FIG. 1, separated to configuring components. FIG. 2 is a side view of the above components.

In FIGS. 1 and 2, the single capped fluorescent lamp has a base 110, a cover part 120, and an arc tube 130.

Further, in the embodiment, an example will be explained in which a base body 111 is black or dark color (not white). Because of this, in FIG. 1, slant lines are put on the base body 111 to clearly show that it is colored. The slant lines are omitted in FIG. 2 and also in FIG. 3 which will be explained later.

In the following, the components will be discussed.

The base 110 has an inserting part to a holder (a luminaire, a luminaire with a socket) and an engaging part with the cover part 120. The base 110 includes the base body 111 made of thermoplastic resin and four metal pins 112. Four boles 113 are formed on the base body 111, and the pins 112 are press-fitted into the four holes 113, respectively. In this embodiment, an example of the base 110 includes four pins 112; however, the number of pins is not limited to four.

The cover part 120 is made of thermoplastic resin, and is joined to the base 110 and the arc tube 130. The cover part 120 includes a hole in which the arc tube 130 is set. The cover part 120 is engaged with the base 110.

The arc tube 130 is a part to light and is set to the cover part 120. The arc tube 130 is connected electrically via a lead wire (not illustrated).

The thermoplastic resin is, for example, PBT (polybutylene terephthalate), PET (polyethylene terephthalate), etc.

FIG. 3 shows the base 110 in detail.

(A) in FIG. 3 shows a front view, (B) and (C) in FIG. 3 show side views, (D) in FIG. 3 shows a perspective view, and (E) in FIG. 3 shows a cross-section view (a part of the base body 111). (F) in FIG. 3 shows a side view of a pin 112 (a partial cross-section view (the right side of the center line)).

As shown in FIG. 3, the four metal pins 112 are press-fitted to the base body 111 by setting two pairs of the four pins in parallel.

(E) in FIG. 3 shows a cross-section view of a base body part of the base body 111 including a hole 113. A length (a diameter) shown by Oh is a hole diameter of the hole 113 provided at the base body. This corresponds to a diameter of the hole 113.

In (F) in FIG. 3, a length (a diameter) shown by Dp is an outer diameter of a pin 112. A part having the outer diameter Dp includes a part contacting to a part having the hole diameter Dh of a hole 113. The pin 112 is inserted to the hole 113 formed on the base body 111 and retained by pressure received from the hole 113.

A pin retaining force is force by which the base body 111 retains the pins 112 (a pin torque of the base). The pin retaining force is represented by a value of Nm (Newton meter).

An "initial pin retaining force Fi" is a retaining force after the metal pins 112 are press-fitted to the base body 111 and before the fluorescent lamp is used (in mint state; before the fluorescent lamp is burned). The outer diameter Dp and the hole diameter Dh relate to the initial pin retaining force Fi.

A "pin retaining force Fe after use" is a pin retaining force by which the base body 111 retains the metal pins 112 after the lamp is burned for 10,000 hours.

The burning time of 10,000 hours corresponds to a rated life (a rated life time) of a typical compact fluorescent lamp FHT57W.

The "rated life" is a life duration that is announced based on a mean value of lives of the lamps of the same type which have been produced for a long time. The rated life is obtained by, for example, calculating a mean value of lives of many lamps which are tested by operation that repeatedly puts the light on for 2.75 hours and the light off for 0.25 hours. Therefore, not every lamp terminates its life when the rated life is over. Further, lives may vary depending on voltages, frequency of switching, manufacturing conditions, etc.

A "life" is defined by a total burning time of a lamp when the lamp is burned under predetermined condition until the lamp cannot be burned any more or a total burning time of a lamp when the lamp is burned until luminous flux becomes 70% of initial luminous flux (60% in case of lamps of a certain color rendering type and compact fluorescent lamps) whichever is shorter.

Further, simply terming "pin retaining force after use" (without Fe), it means a pin retaining force after the lamp is burned for a predetermined time, and also means a pin retaining force after the fluorescent lamp is used (after the fluorescent lamp is burned) for a predetermined time. The predetermined time means an arbitrary time such as a rated life and so on (this is not limited to a rated life).

Figure 4:
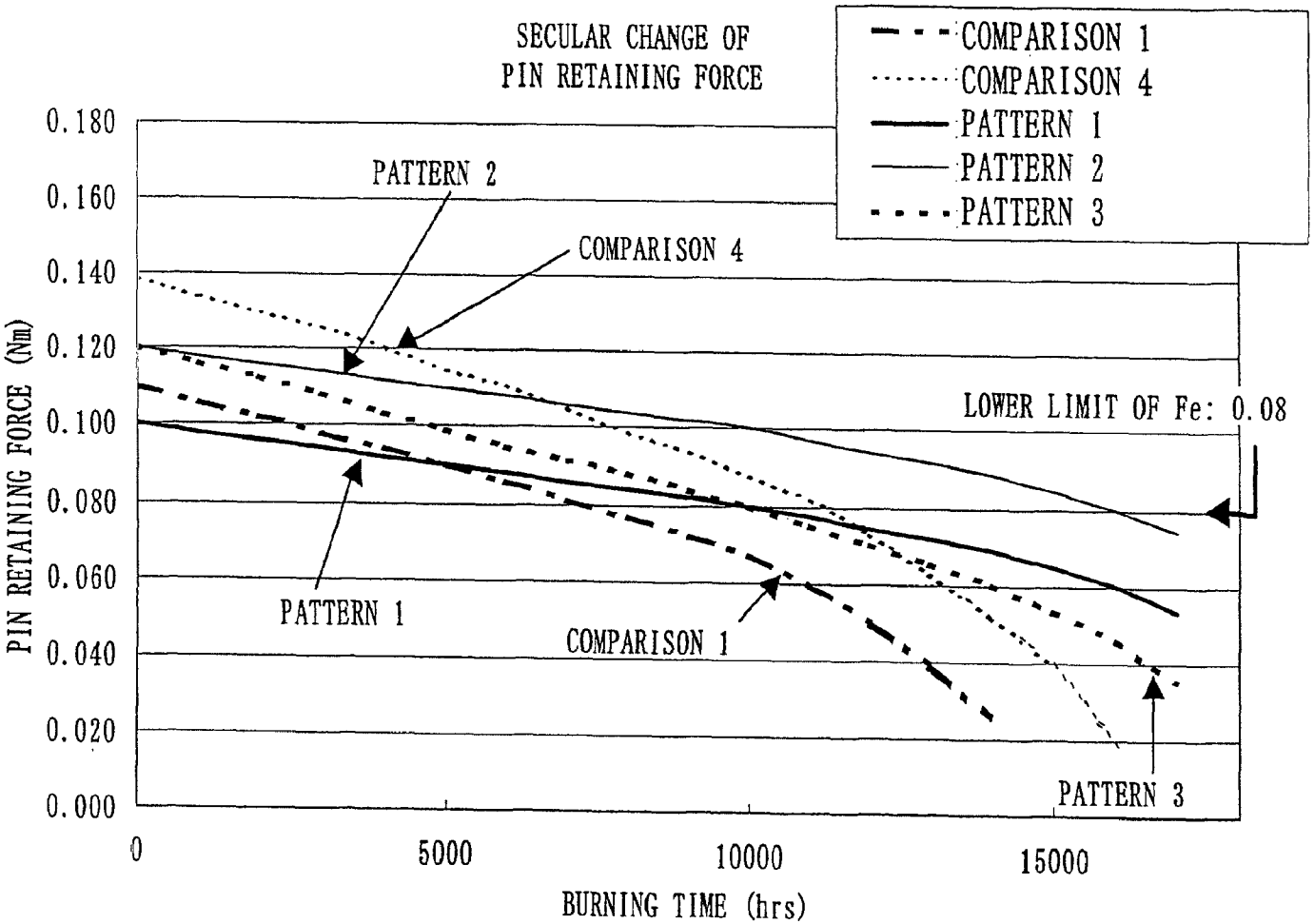
FIG. 4 is a diagram (a graph) outlining secular change of the pin retaining force of the base.

FIG. 4 is a diagram (a graph) outlining secular change of the pin retaining force of the base.

In FIG. 4, the pin retaining force is a value obtained by using the fluorescent lamp shown in FIGS. 1 through 3. Further, temperature of the base of the fluorescent lamp becomes at least 70 degrees Celsius while the lamp is burned.

For pattern 1, the initial pin retaining force Fi is 0.1; for pattern 2, the initial pin retaining force Fi is 0.12; and for pattern 3, the initial pin retaining force Fi is 0.12. Any of the patterns shows an example of a case in which the pin retaining force Fe after use (a pin retaining force after the lamp is burned for a rated life) exceeds the lower limit value 0.08. Pattern 3 shows a case in which the pin retaining force decreases more than cases of pattern 1 and pattern 2.

Further, Comparison 1 shows an example of the base body 111 containing the glass filler of 15 wt % and the white pigment $TiO_2$ addition of 5 wt %.

Further, Comparison 4 shows an example of the base body 111 containing the glass filler of 60 wt % and the white pigment $TiO_2$ addition of 5 wt %.

Here, in the following explanation, the glass filler and the quantity of white pigment addition will be described as a percentage by weight to the base body 111 when they are referred to without special remarks (including a case of showing the content and quantity with only %).

The fluorescent lamps of pattern 1, pattern 2, and pattern 3 have the following characteristics.

At the end of the life, there occurs some failure such as dropping, slanting, etc. of the pins 112 press-fitted into the base body 111 of the fluorescent lamp. One of the reasons of such failure is that the base body 111 is degraded due to the heat of the fluorescent lamp while the lamp is burned. It is possible to suppress occurrence of the failure when the pin retaining force Fe is at least 0.08 Nm. It is preferable that the initial pin retaining force Fi should be no more than 0.12 Nm, and the pin retaining force after use be at least 0.08 Nm.

From the above example, it is preferable that a rate Fe/Fi should be at least 0.66 (0.08/0.12). Further, on considering longevity of the rated life of 15,000 hours of the fluorescent lamp that will be required in the future, it is more desirable that the rate Fe/Fi should be at least 0.80 (0.80/0.10, or 0.10/0.12) (refer to patterns 1 and 2 in FIG. 4). Yet further, viewing from FIG. 4, when the rate Fe/Fi is at least 0.8, good values are maintained even if the pin retaining force Fe after use decreases (suddenly decreases) after the lamp is burned for 15,000 hours. In particular, in case of pattern 2 of FIG. 4, values of at least 0.08 Nm are maintained after the lamp is burned for 15,000 hours.

It can be said that as a value of the rate Fe/Fi approaches to 1.00, the degradation of the base body 111 can be suppressed.

In addition, from the facts that the pin retaining force Fe after use cannot be greater than the initial pin retaining force Fi and that the pin retaining force is degraded by burning the lamp, it can be also said that the pin retaining force Fe after use is less than the initial pin retaining force Fi (the pin retaining force Fe after use < the initial pin retaining force Fi). Accordingly, the rate Fe/Fi is less than 1.0. Namely, when a desired value of the pin retaining force Fe after use is fixed, the initial pin retaining force Fi has to be greater than the lower limit value of the desired value of the pin retaining force Fe after use.

As shown in Comparisons 1 and 4 of FIG. 4, the decrease of the pin retaining force is significant especially after the rated life is over. It is important to prevent this decrease to suppress the failure of the fluorescent lamp at the end of life.

Therefore, it is desired to suppress the decrease of the pin retaining force of the fluorescent lamp at the end of life.

Through the above explanation, it is found that a preferable value of the rate Fe/Fi, which is a rate of the initial pin retaining force Fi after using the lamp for the rated life and the pin retaining force Fe after use, is at least 0.66, in particular at least 0.80.

Next, the base body 111 will be discussed.

For the base body 111, it is found that a preferable value of the rate Dh/Dp, which is a rate of the hole diameter Dh and the outer diameter Dp is at least 0.89 but no more than 0.99, in particular at least 0.96 but no more than 0.98.

For addition contained in the thermoplastic resin of the base body 111, it is found that the pin retaining force can be maintained when the white pigment is no more than 3 wt %, and the glass filler, which is used as a reinforcement member, is at least 10 wt % but no more than 30 wt %. Further, it is found that a preferable value of the white pigment is no more than 2 wt %. From the fact that it is a reason of the degradation to add the white pigment to the thermoplastic resin, it can be said that the lower limit value of the white pigment is at least 0 wt %.

On the other hand, it is found that containing black pigment of at least 0.2 wt % in the thermoplastic resin of the base body 111 makes discoloring by the heat of burning inconspicuous without using the white pigment. Further, the discoloring by the heat can be made inconspicuous by adding the black pigment of at least 0.2 wt % but no more than 1.0 wt %.

As shown in FIG. 1, for the fluorescent lamp, by coloring the resin base body 111 in black or dark color and the resin cover part 120 white, the base 110 colored in black or dark color is covered by the white cover part and is not seen by a user. Because of this, an outer appearance can be kept white. Further, when the user sees the base 110 at the time of attaching/removing the lamp, as the base is colored in black or dark color, and the discoloring by the heat of burning is inconspicuous, the user is not impressed by the degradation of the base.

Hereinafter, test results according to the first to fifth examples will be shown by referring to FIGS. 5 to 17.

Figure 19:
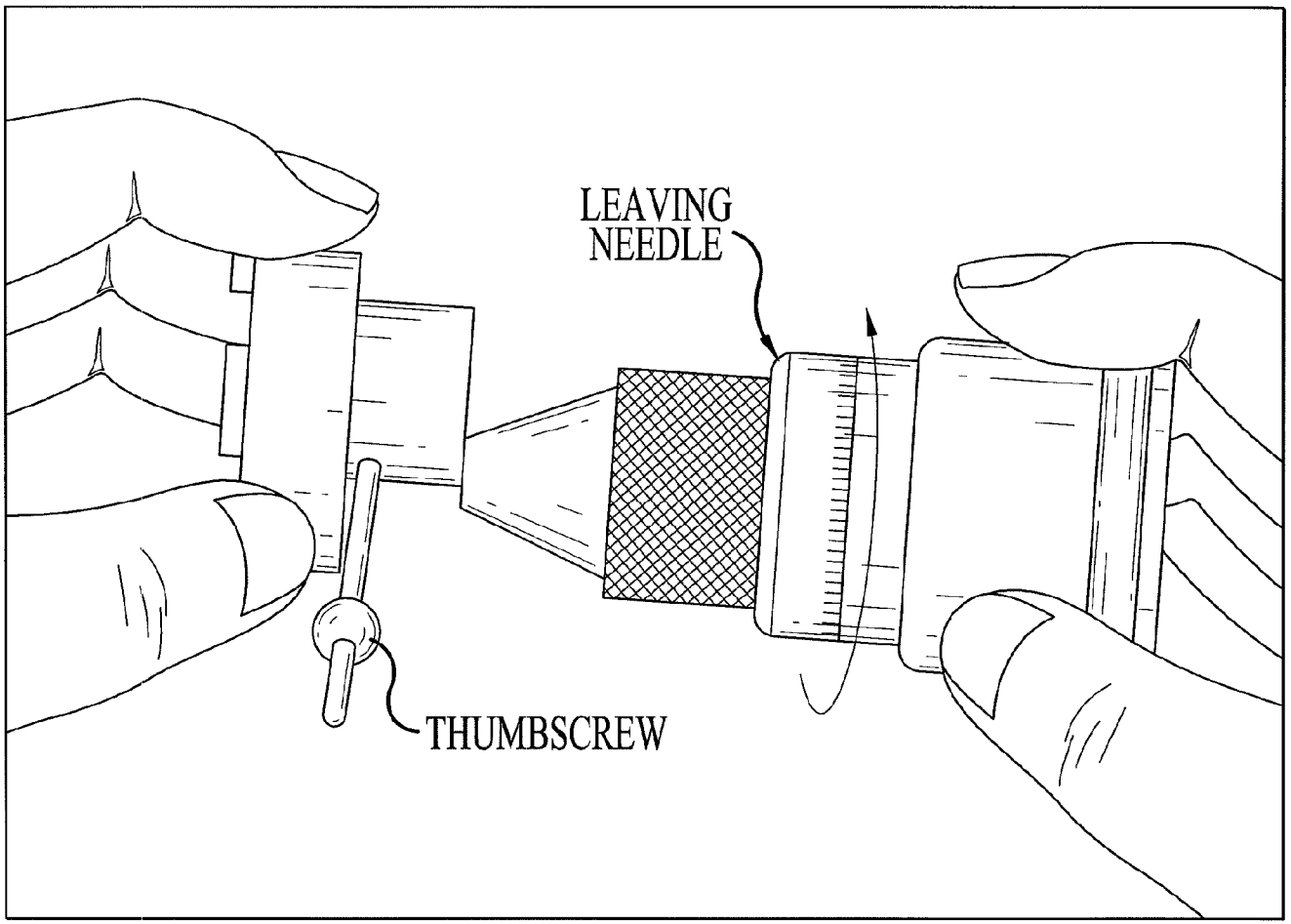
FIG. 19 shows an example of a torque gauge.

As a measurement method for a pin torque of the base, a torque gauge (an example of measurement devices) shown in FIG. 19 is used. The following shows a detail of the torque gauge of FIG. 19.

Manufacturer: Kabushiki Kaisha Tonichi Seisakujo

Type: ATG12CN

Specification: 1-12 (cNm); a minimum unit: 0.2 (cNm)

As a standard, all four pins need to have a torque of 8.0 (cNm) (0.08 Nm).

The measurement is carried out by the following:

(1) insert a pin to be measured to a top of the torque gauge and fix firmly by a thumbscrew;

(2) set a leaving needle of the torque gauge to 0;

(3) twist the torque gauge body. In FIG. 19, the torque gauge is twisted toward the direction of an arrow.

(4) when the torque reaches the maximum, the press-fitted part of the pin and the base are slipped, and the leaving needle stops.

(5) twist backwards the torque gauge body and read a value indicated by the leaving needle. To check the retaining force of the pin and base, the measurement is done by using torque strength. Namely, how much retaining force the pin has is read as data by measuring a twist torque. The pin retaining force is quantified by this operation.

(6) operations of the above (1) through (5) are repeated for other pins.

The above explanation of the embodiment is based on the single capped fluorescent lamp shown in FIGS. 1 to 3; however, the embodiment can be applied to other fluorescent lamps having a base of types shown in a table of FIG. 20.

Further, in the above embodiment and the following examples, the explanation is done based on an example case in which the base body 111 is made of thermoplastic resin and the pins 112 are metal; however, an application of the embodiment and examples is not limited to this case. The base body 111 and the pins 112 can be made of other materials.

EXAMPLE 1

Figure 6:
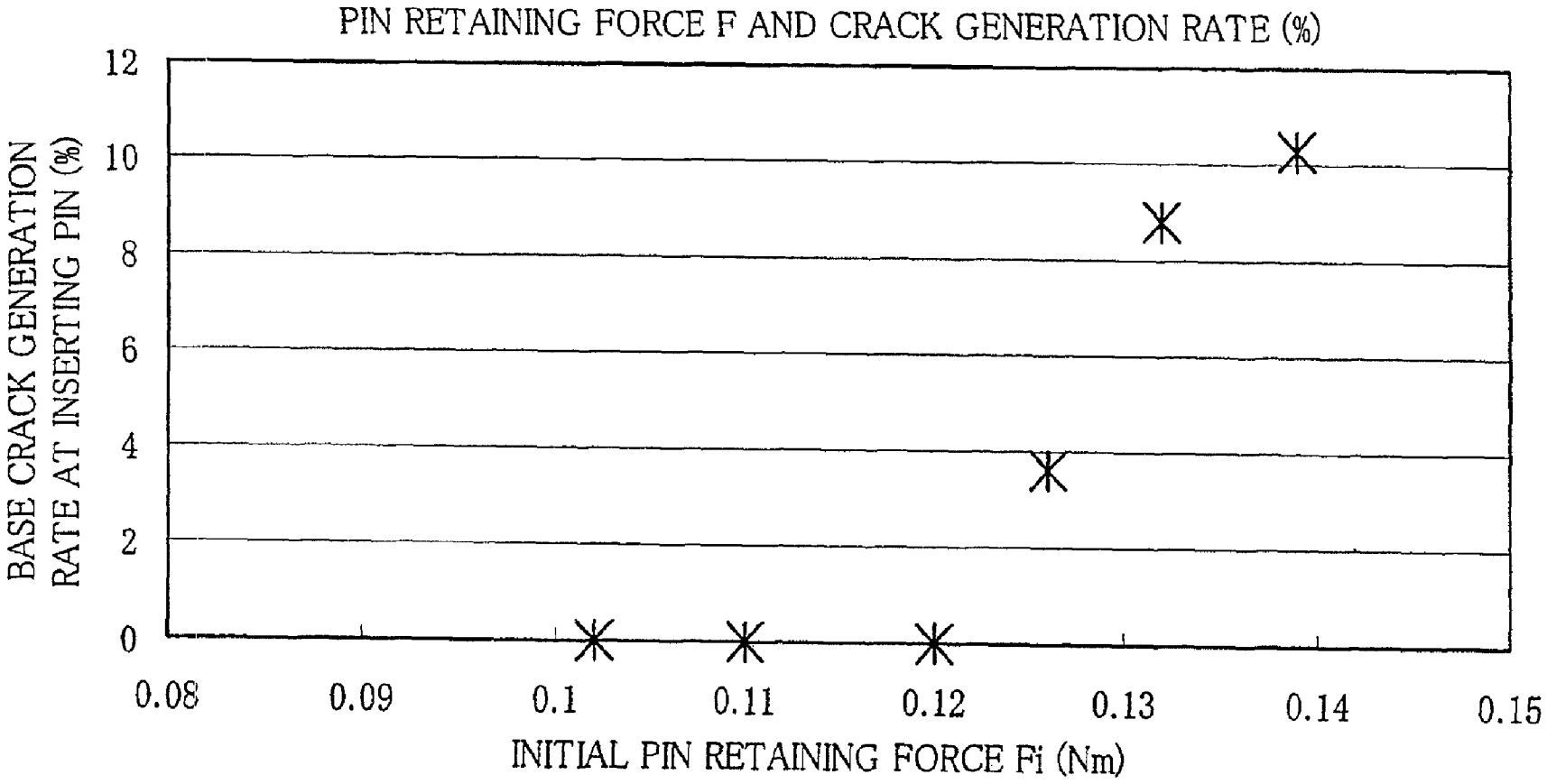
FIG. 6 is a diagram (a graph) showing a test result of relation between an initial pin retaining force Fi and a crack generation rate (%) at the time of inserting a pin.

FIGS. 5 and 6 are diagrams showing test results of relation between an initial pin retaining force Fi and a crack generation rate (%) at the time of inserting a pin.

Tests are carried out by an example case in which the fluorescent lamp is FHT57W lamp, the base is GX24q-5 base, and the holder is GX24q-5 holder. Here, in the subsequent examples from the second, tests are carried out by using the fluorescent lamp, the base, and the holder of the same type.

For data of FIGS. 5 and 6, PBT is used for the base body 111 as an example of the thermoplastic resin. To the base body 111, $TiO_2$ (titanium dioxide) of 5 wt % is added as the white pigment. The tests are carried out by changing the glass filler content (wt %) and Dh/Dp to the values shown in the table. By changing either of the glass filler content (wt %) and Dh/Dp, the initial pin retaining force Fi is changed. When the pins 112 are inserted to the base on the manufacturing line, the number of cracked bases is counted per 1,000 bases, and the counted number per 1,000 bases is shown as a crack generation rate (%).

FIGS. 5 and 6 shows that when the initial pin retaining force Fi exceeds 0.12 Nm (Fi is at least 0.126 in FIG. 5), a crack of the base is generated.

Accordingly, it is found that the initial pin retaining force Fi is preferably no more than 0.12 Nm.

EXAMPLE 2

FIG. 7 shows a test result of relation between a pin retaining force Fe(Nm) after use and occurrence of a pin-dropping or a pin-slanting at the time of attaching/removing a fluorescent lamp to/from a lamp holder after the lamp is burned for 10,000 hours.

For data shown in FIG. 7, PBT is used for the base body 111 as an example of thermoplastic resin. The tests are carried out by changing values of glass filler content (wt %), the value of Dh/Dp, and the quantity of white pigment addition ($TiO_2$) (wt %) to the values shown in FIG. 7. By changing each of the values, the pin retaining force Fe after use is changed, and pin-droppings and pin-slantings at the time of attaching/removing the lamp to/from the lamp holder are checked. Twenty lamps are tested as samples after the lamps are burned for 10,000 hours. When attaching/removing operation of the lamps to/from holders is repeated ten times, the pin-droppings from the base and the pin-slantings are counted.

A pin-dropping means that a pin 112 press-fitted to a hole 113 of the base body 111 drops.

A pin-slanting means that a pin 112 slants from the foot because of deformation of a hole 113 of the base body 111 to which the pin 112 is inserted. The pin-slanting is different phenomenon from the deformation of the pin itself.

As shown in FIG. 7, when the pin retaining force Fe after use is at least 0.08 Nm, neither a pin-dropping nor a pin-slanting occurs. It is found that there occur failures such as a pin-dropping and a pin-slanting when the pin retaining force Fe after use becomes less than 0.08 Nm.

EXAMPLE 3

Figure 8:
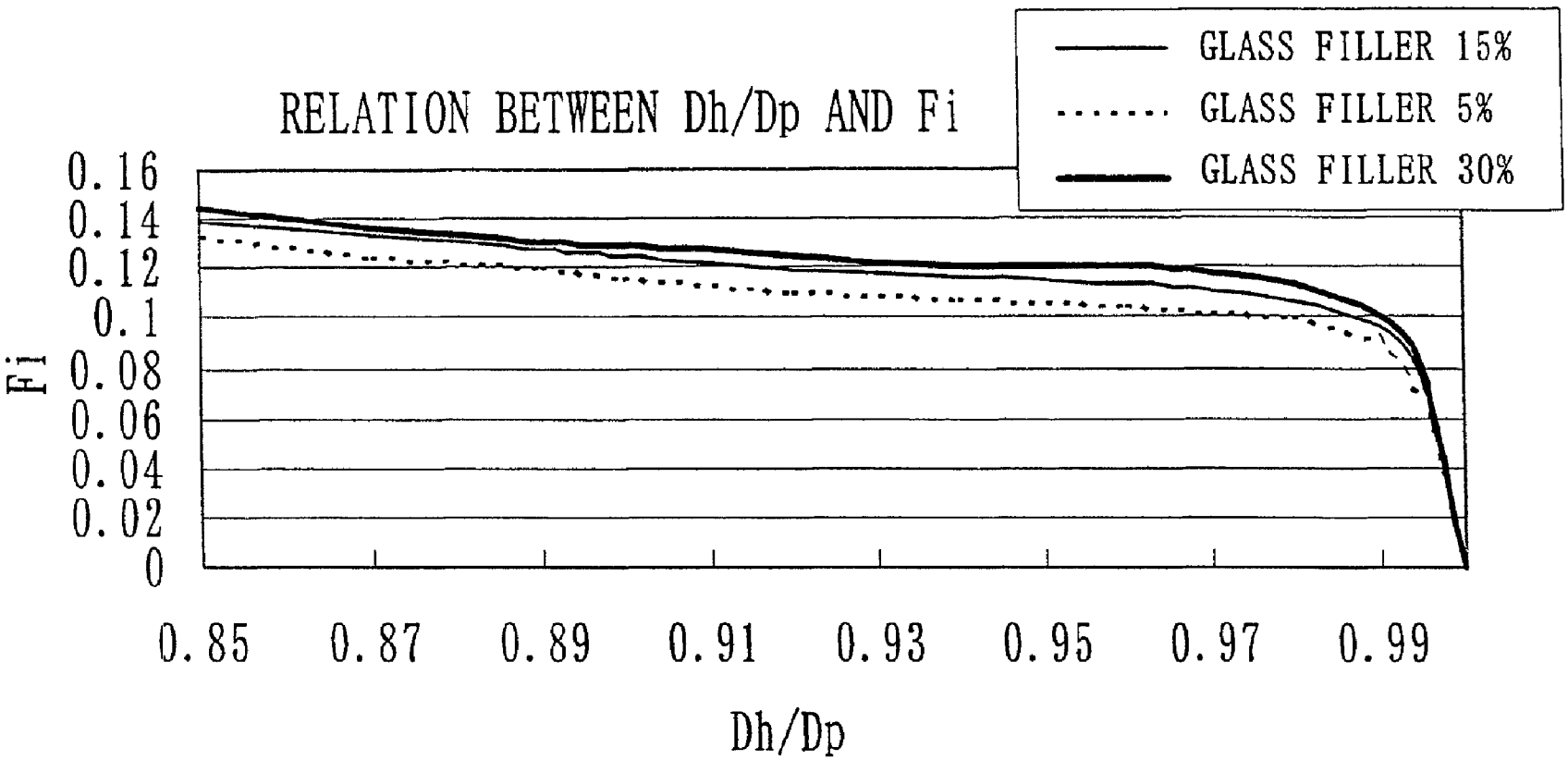
FIG. 8 is a diagram (a graph) showing a test result of relation between a rate Dh/Dp and an initial pin retaining force Fi (Nm).

FIGS. 8 and 9 show a test result of relation between Dh/Dp and an initial pin retaining force Fi (Nm).

In the data of FIGS. 8 and 9, PBT is used for the base body 111 as an example of thermoplastic resin. $TiO_2$ (titanium dioxide) is not added (0 wt %) to the base body 111 as the white pigment. The tests are carried out by changing values of glass filler content (wt %) and values of DWDp to the values shown in FIG. 9. For plural combinations of each value, the initial pin retaining force Fi is measured.

At least one lamp is prepared as a test sample for each of the combinations of the initial pin retaining force Fi and the rate Dh/Dp. The tests are carried out by measuring the pin retaining force (torque) of three pins out of the four pins press-fitted to each of the lamps that correspond to the above combinations.

When Dh/Dp is at least 0.96 but no more than 0.98, in all cases when the glass filler content is 5 wt %, 15 wt %, and 30 wt %, the initial pin retaining force Fi stays within a range of at least 0.10 Nm but no more than 0.12 Nm.

When Dh/Dp is at least 0.89 but no more than 0.99, there are some cases in which the initial pin retaining force Fi is not within the range of at least 0.10 Nm but no more than 0.12 Nm according to the glass filler content. When Dh/Dp is at least 0.92 but no more than 0.98, in cases of at least two values of the glass filler content, the initial pin retaining force Fi is within the range of at least 0.10 Nm but no more than 0.12 Nm. When Dh/Dp is 0.94, in case of the glass filler of 30 wt %, the initial pin retaining force Fi is 0.121, which slightly exceeds the range that is up to 0.120.

As shown in FIGS. 8 and 9, it is found that applicable values of Dh/Dp are at least 0.89 but no more than 0.99, and Dh/Dp is preferably at least 0.92 but no more than 0.98, in particular, at least 0.96 but no more than 0.98.

EXAMPLE 4

In the fourth example, test results will be discussed, in which components related to the pin retaining force is tested when content rate of materials of the base body 111 is changed.

FIGS. 10 and 11 are tables showing combinations of glass filler content and quantity of white pigment addition. $TiO_2$ is used as an example of the white pigment. The glass filler content and the quantity of white pigment addition arc shown by percentage by weight to the base body 111. In the fourth example, PBT is used for the base body 111 as an example of thermoplastic resin.

Labels of Examples 1 to 21 and Comparisons 1 to 6 are used as identifiers to specify the above combinations.

For Examples 1 to 21 and Comparisons 1 to 6, PBT is used for the base body 111 as an example of thermoplastic rosin.

Further, the tests are carried out by setting Dh/Dp to 0.97 for Examples 1 to 17 and Comparisons 1 to 6, and by setting Dh/Dp to 0.85 for Examples 18 to 21.

FIGS. 12 and 13 are tables showing measurement result of the pin retaining force for each combination of Examples and Comparisons shown in FIGS. 10 and 11.

At least two lamps are prepared as test samples for each of examples. The tests are carried out by measuring the pin retaining force (torque) of three pins out of the four pins press-fitted to each of the lamps. Different lamps are used for measuring the initial pin retaining force Fi and the pin retaining force Fe after use.

As shown in FIG. 12, the values of Fi, Fe, Fe/Fi are within a good range when the glass filler is at least 5 wt % but no more than 30 wt %, and the quantity of white pigment addition is at least 0 wt % but no more than 3%.

Further, it is found that it is more desirable that the glass filler be at least 5 wt % but no more than 30 wt % and the quantity of white pigment addition be at least 0 wt % but no more than 2 wt %. It is more desirable because the degradation of the base body 111 can be suppressed as the value of Fe/Fi is large. Viewing from the value of Fe/Fi, it is more desirable when the glass filler is at least 5 wt % but no more than 30 wt % and the quantity of white pigment addition is at least 0 wt % but no more than 1 wt %.

When the glass filler is at least 5 wt % but no more than 30 wt % and the quantity of white pigment addition is 0 wt % or when the glass filler is at least 5 wt % but no more than 15 wt % and the quantity of white pigment addition is 1 wt %, the value of Fe/Fi becomes at least 0.08, which is in particular preferable.

By setting the glass filler content and the quantity of white pigment addition within the above range, it is possible to maintain the pin retaining force Fe after use even if the fluorescent lamp is used for longer than the rated life.

Further, as shown in FIG. 13, in all cases of Examples shown in FIG. 11, the initial pin retaining force Fi is large, and thus it is found not practical from the result of FIG. 5, since the crack generation rate is high at the time of inserting the pin.

FIG. 14 is a table showing a base crack generation rate and the number of occurrences of a pin-dropping or a pin-slanting for representative cases of Examples.

FIG. 14 uses Examples 7, 4, and 17 and Comparisons 1 and 4 shown in FIG. 10. For the crack generation rate (%), tests are carried out similarly to Example 1, and for a pin-dropping or a pin-slanting, tests are carried out similarly to Example 2.

In Comparison 4, the value of Fi is 0.139, which exceeds the appropriate range and the crack generation rate is high. In Comparison 1, the value of Fe is 0.067, which is less than 0.08, and the number of pieces in which a pin-dropping or a pin-slanting occurs is large. In Examples other than the above, neither the crack generation rate nor the number of pieces in which a pin-dropping or a pin-slanting occurs arises, which shows the pin retaining force is sufficient. Accordingly, by using the base body 111 consisting of composition defined by the above examples, it is possible to maintain the pin retaining force of the base 100 after the rated life is over.

Figure 15:
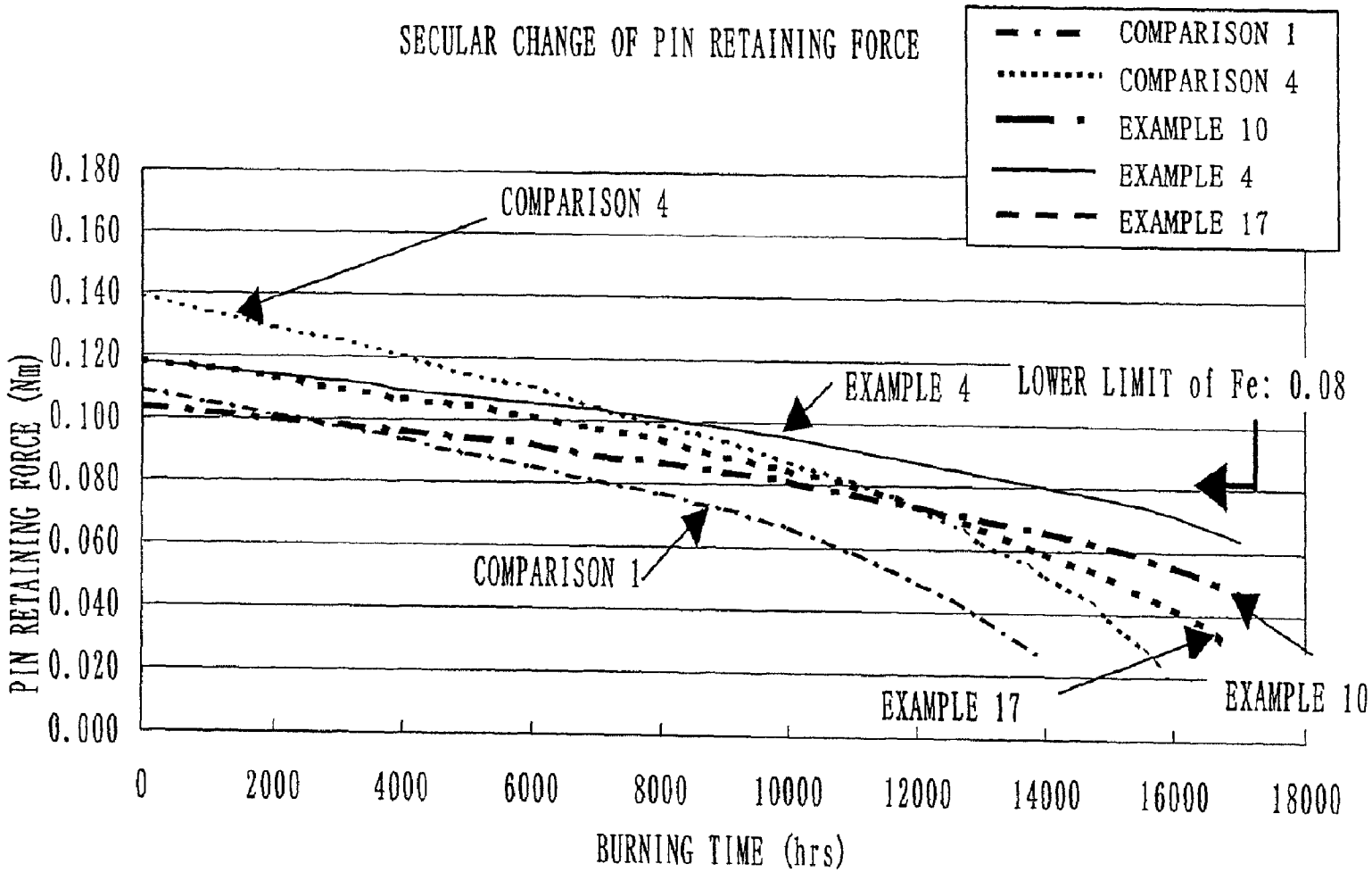
FIG. 15 shows a measurement result of secular change of the pin retaining force for representative cases of Examples.

FIG. 15 shows a measurement result of secular change of the pin retaining force for representative cases of Examples. FIG. 15 uses Examples 4, 10, and 17, Comparisons 1 and 4 shown in FIG. 10.

As the tests involve destruction, the same number of lamps as the number of measuring times is prepared, and the measurement is carried out every 1,000 hours from the starting time of the test until 16,000 hours have passed. Accordingly, at least 16 lamps are prepared, and three out of four pins press-fitted to each lamp are used for the measurement.

FIG. 15 shows that in Examples 4, 10, and 17, the pin retaining force maintains 0.08 Nm that is a necessary value for retaining the pin, and further shows that the pin retaining force does not suddenly fall down after the lamp is burned for longer than 10,000 hours, which suggests the lamps can be used for longer life time.

From FIG. 15, it is understood that in Examples 4, 10, and 17, especially in Examples 4 and 10, the slope of the graph is gradual, which means the pin retaining force decreases slowly. Especially in Example 4, the pin retaining force Fe after use is kept to be 0.08 Nm even if the lamp is burned for longer than 15,000 hours, which means it is possible to extend the rated life of the fluorescent lamp. It is found that the necessary pin retaining force can be maintained after the lamp is burned for long time when the value of Fi is closer to 0.120 Nm, the value of Fe/Fi is large, and the degradation of the pin retaining force is suppressed. Therefore, these examples can be adequately applied to a case in which the rated life is set longer than 10,000 hours (15,000 hours, for example).

As explained above, by appropriately combining the glass filler content and the quantity of white pigment addition, it is possible to maintain the pin retaining force, which enables to lengthen the life of the lamp. As shown in FIG. 15, since the pin retaining force can be maintained and does not suddenly fall even if the burning time exceeds 10,000 hours, it is found that the examples enables to further lengthen the life of the lamp.

EXAMPLE 5

In Example 5, results of tests will be discussed, in which relation between carbon black content in the base body 111 and discoloring, and relation between the carbon black content and Fi and Fe are examined.

FIG. 16 is a table showing combinations of carbon black content (also called "carbon content") and quantity of white pigment addition. $TiO_2$ is used as an example of white pigment. The carbon black content and the quantity of white pigment addition are shown as a percentage by weight to the base body 111. PBT is used for the base body 111 as an example of thermoplastic resin. Further, the base body 111 contains the glass filler of 15 wt %. The tests are carried out when Dh/Dp is 0.97.

Examples 3, 7, 11, Examples 22 to 31 , Comparisons 1 and 5 are used as identifiers to specify the above combinations.

FIG. 17 is a table showing a test result of relation between carbon black content and discoloring. The combinations of the carbon black content and the quantity of white pigment addition are the same as shown in FIG. 16. The tests are carried out by five subjects who visually observe the base 100 of the fluorescent lamp. One subject visually observes three samples. "Discoloring is recognized" by one subject means that discoloring of at least one sample out of the three samples is recognized.

In case the quantity of white pigment addition is less than 2 wt %, the carbon black content is desired to be at least 0.2 wt %, in particular at least 0.5 wt %.

In case the quantity of white pigment addition is 2 wt %, the carbon black content is desired to be at least 0.1 wt %, in particular at least 0.2 wt %.

In case the quantity of white pigment addition is 5 wt % or 10 wt %, the discoloring is not recognized even if the carbon black is not added.

FIG. 18 is a table showing a test result of relation between carbon black content, and an initial pin retaining force Fi and a pin retaining force Fe after use.

The thermoplastic resin turns completely to black when the carbon black of 0.5 wt % is contained.

As shown in FIG. 18, in case the carbon black content is 1.0 wt %, the values of Fi, Fe and Fi/Fe are within a proper range. Therefore, it can be said that the carbon black content of around 1 wt % may not cause problems.

In addition, the carbon black content does not cause an adverse effect within the range of 1.0 wt % as shown in FIG. 18; however, it is anticipated that too much addition of the carbon black may cause a short circuit because of the decrease of resistivity of surface of the base. For example, in case of adding a large quantity of carbon black (5-10 wt %, for example), the initial pin retaining force Fi is increased, which may raise the number of cracks of the bases at the time of manufacturing.

Further, from FIGS. 17 and 18, for the white pigment within the proper range ($TiO_2$ of 0-2 wt %), by which the degradation of the base due to the burning may hardly cause a problem, it can be said that the carbon black content of 0.2 wt %, by which level the discoloring may hardly generate a problem (cases of a white circle and a black circle in FIG. 17 correspond to this level, and a case of a triangle is judged to be not good), would be preferable.

INDUSTRIAL APPLICABILITY

According to the preferred embodiment of the present invention, it is possible to improve the pin retaining force of the base body. Therefore, the fluorescent lamp can be burned for longer hours.

Further, since the pin retaining force can be improved, it is possible to reduce the depth of an inserting part of the pins (to shorten the pins) at the time of press-fitting the pins to the base body. This enables to reduce the cost of the pins. In addition, since the pins are shortened, operating efficiency can be improved at a step for inserting a lead wire.

The invention claimed is:

1. A base of a fluorescent lamp comprising:

a base body made of thermoplastic resin; and a pin press-fitted to a hole formed on the base body, wherein the thermoplastic resin contains white pigment of at least 0 wt % and no more than 3 wt % and glass filler of at least 5 wt % and no more than 30 wt %, and wherein an initial pin torque Fi by which the base body retains the pin before use of the fluorescent lamp is at least 0.10 Nm and no more than 0.12 Nm.

2. The base of claim 1, wherein the base body is built to sustain a pin torque Fe by which the base body retains the pin after the fluorescent lamp has been burned for an amount of time substantially equivalent to 10,000 hours, of at least 0.08 Nm.

3. The base of claim 1, wherein the base body is built to sustain a sufficient amount of pin torque Fe by which the base body retains the pin after the fluorescent lamp has burned for an amount of time substantially equivalent to 10,000 hours, relative to an initial pin torque Fi by which the base body retains the pin before use of the fluorescent lamp, so that the ratio Fe/Fi is at least 0.66.

4. The base of claim 1, wherein the base body is built to sustain a sufficient amount of pin torque Fe by which the base body retains the pin after the fluorescent lamp has burned for an amount of time substantially equivalent to 10,000 hours, relative to an initial pin torque Fi by which the base body retains the pin before use of the fluorescent lamp, so that the ratio Fe/Fi is at least 0.8.

5. The base of claim 1, wherein the ratio Dh/Dp of a hole diameter Dh of the hole formed on the base body and an outer diameter Dp of the pin is at least 0.89 and no more than 0.99.

6. The base of claim 1, wherein the ratio Dh/Dp of a hole diameter Dh of the hole formed on the base body and an outer diameter Dp of the pin is at least 0.92 and no more than 0.98.

7. The base of claim 1, wherein the ratio Dh/Dp of a hole diameter Dh of the hole formed on the base body and an outer diameter Dp of the pin is at least 0.96 and no more than 0.98.

8. The base of claim 1, wherein a rated life of the lamp is 10,000 hours.

9. The base of claim 1, wherein the thermoplastic resin contains the white pigment of at least 0 wt % and no more than 2 wt %.

10. The base of claim 1, wherein the thermoplastic resin contains the white pigment of at least 0 wt % and no more than 1 wt %.

11. The base of claim 1, wherein the thermoplastic resin contains black pigment of at least 0.1 wt %.

12. The base of claim 1, wherein the thermoplastic resin contains black pigment of at least 0.2 wt %.

13. The base of claim 1, wherein the thermoplastic resin contains black pigment of at least 0.5 wt %.

14. The base of claim 11, wherein the thermoplastic resin contains carbon black as the black pigment.

15. A fluorescent lamp comprising a base including:

a base body made of thermoplastic resin; and a pin press-fitted to a hole formed on the base body, wherein the thermoplastic resin contains white pigment of at least 0 wt % and no more than 3 wt % and glass filler of at least 5 wt % and no more than 30 wt %, and wherein an initial pin torque Fi by which the base body retains the pin before use of the fluorescent lamp is at least 0.10 Nm and no more than 0.12 Nm.

16. The fluorescent lamp of claim 15, wherein a temperature of the base during burning is at least 70 degrees Celsius.

17. The fluorescent lamp of claim 15, wherein four metal pins as the pin are press-fitted to the four holes as the hole formed on the base body by setting two pairs of the four metal pins in parallel, the fluorescent lamp further comprising:

a cover part engaged with the base body; and an arc tube set to a hole provided on the cover part.

18. The fluorescent lamp of claim 17, wherein the base body is one of black and dark color, and the cover part is white.

* * * * *

UNITED STATES PATENT AND TRADEMARK OFFICE

CERTIFICATE OF CORRECTION

PATENT NO. : 8,188,646 B2
APPLICATION NO. : 12/105930
DATED : May 29, 2012
INVENTOR(S) : Mitsuhiro Ikeda et al.

It is certified that error appears in the above-identified patent and that said Letters Patent is hereby corrected as shown below:

ON THE TITLE PAGE:

At item (62), change the Related U.S. Application Data to read as follows:

--Division of application No. 10/544,831, filed as application No. PCT/JP2003/11207 on Sep. 2, 2003, now Pat. No. 7,456,559.--

Signed and Sealed this
Fourth Day of September, 2012

David J. Kappos

David J. Kappos
*Director of the United States Patent and Trademark Office*